US011421828B2

(12) United States Patent
Hikmet et al.

(10) Patent No.: US 11,421,828 B2
(45) Date of Patent: Aug. 23, 2022

(54) LED FILAMENT ARRANGEMENT

(71) Applicant: SIGNIFY HOLDING B.V., Eindhoven (NL)

(72) Inventors: Rifat Ata Mustafa Hikmet, Eindhoven (NL); Ties Van Bommel, Horst (NL); Johannes Petrus Maria Ansems, Hulsel (NL); Robert Jacob Pet, Waalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/419,789

(22) PCT Filed: Jan. 21, 2020

(86) PCT No.: PCT/EP2020/051334
§ 371 (c)(1),
(2) Date: Jun. 30, 2021

(87) PCT Pub. No.: WO2020/152124
PCT Pub. Date: Jul. 30, 2020

(65) Prior Publication Data

US 2022/0082213 A1 Mar. 17, 2022

(30) Foreign Application Priority Data

Jan. 24, 2019 (EP) ..... 19153516

(51) Int. Cl.

| | |
|---|---|
| ***F21K 9/232*** | (2016.01) |
| ***F21K 9/68*** | (2016.01) |
| ***F21K 9/235*** | (2016.01) |
| *F21Y 115/10* | (2016.01) |

(52) U.S. Cl.
CPC ..... *F21K 9/232* (2016.08); *F21K 9/235* (2016.08); *F21K 9/68* (2016.08); *F21Y 2115/10* (2016.08)

(58) Field of Classification Search
None
See application file for complete search history.

(56) References Cited

U.S. PATENT DOCUMENTS

| | | | |
|---|---|---|---|
| 2015/0036341 | A1 | 2/2015 | Ge et al. |
| 2016/0258579 | A1 | 9/2016 | Dulley et al. |

FOREIGN PATENT DOCUMENTS

| | | | |
|---|---|---|---|
| CN | 203771136 | U | 8/2014 |
| CN | 104033774 | B | 8/2016 |
| CN | 105953101 | A | 9/2016 |
| CN | 206694870 | U | 12/2017 |
| DE | 102016105211 | A1 | 9/2017 |
| DE | 102017103431 | A1 | 8/2018 |
| WO | 2017186150 | A1 | 11/2017 |
| WO | 2018041826 | A1 | 3/2018 |

*Primary Examiner* — Elmito Breval
(74) *Attorney, Agent, or Firm* — Daniel J. Piotrowski

(57) ABSTRACT

A light emitting diode, LED, filament arrangement (100), comprising at least one LED filament (120) comprising an array of a plurality of light emitting diodes (140), LEDs, is provided. The LED filament arrangement comprises at least one light distribution element (200*a*, 200*b*) comprising a solid, at least partially translucent material at least enclosing the at least one LED filament. The at least one light distribution element has a conical shape and is configured to at least partially refract, and at least partially reflect by total internal reflection, the light emitted from the at least one LED filament during operation.

15 Claims, 7 Drawing Sheets

LED FILAMENT ARRANGEMENT

CROSS-REFERENCE TO PRIOR APPLICATIONS

This application is the U.S. National Phase application under 35 U.S.C. § 371 of International Application No. PCT/EP2020/051334, filed on Jan. 21, 2020, which claims the benefit of European Patent Application No. 19153516.0, filed on Jan. 24, 2019. These applications are hereby incorporated by reference herein.

FIELD OF THE INVENTION

The present invention generally relates to lighting arrangements comprising one or more light emitting diodes. More specifically, the present invention is related to a light emitting diode (LED) filament arrangement.

BACKGROUND OF THE INVENTION

The use of light emitting diodes (LED) for illumination purposes continues to attract attention. Compared to incandescent lamps, fluorescent lamps, neon tube lamps, etc., LEDs provide numerous advantages such as a longer operational life, a reduced power consumption, and an increased efficiency related to the ratio between light energy and heat energy.

In particular, there is currently a very large interest in lighting devices and/or arrangements (such as lamps) provided with LEDs, and incandescent lamps are rapidly being replaced by LED-based lighting solutions. It is nevertheless appreciated and desired to have retrofit lighting devices (e.g. lamps) which have the look of an incandescent bulb. For this purpose, it is possible to make use of the infrastructure for producing incandescent lamps based on LED filaments arranged in such a bulb. In particular, LED filament lamps are highly appreciated as they are very decorative.

However, as LED filament lamps are often intended for decorative applications, lamps of this kind may suffer from an unsatisfactory light distribution. For example, LED filaments may have a substantially dipolar emission pattern, wherein the light emission at angles parallel to the elongation of the filament may be low, or even non-existing.

Hence, it is an object of the present invention to try to overcome at least some of the deficiencies of present LED filament lamps regarding their distribution of light during operation.

SUMMARY OF THE INVENTION

Hence, it is of interest to overcome at least some of the deficiencies of present LED filament lamps, in order to improve the distribution of light during operation.

This and other objects are achieved by providing a LED filament arrangement having the features in the independent claim. Preferred embodiments are defined in the dependent claims.

A LED filament is providing LED filament light and comprises a plurality of light emitting diodes (LEDs) arranged in a linear array. Preferably, the LED filament has a length L and a width W, wherein L>5W. The LED filament may be arranged in a straight configuration or in a non-straight configuration such as for example a curved configuration, a 2D/3D spiral or a helix. Preferably, the LEDs are arranged on an elongated carrier like for instance a substrate, that may be rigid (made from e.g. a polymer, glass, quartz, metal or sapphire) or flexible (e.g. made of a polymer or metal e.g. a film or foil).

In case the carrier comprises a first major surface and an opposite second major surface, the LEDs are arranged on at least one of these surfaces. The carrier may be reflective or light transmissive, such as translucent and preferably transparent.

The LED filament may comprise an encapsulant at least partly covering at least part of the plurality of LEDs. The encapsulant may also at least partly cover at least one of the first major or second major surface. The encapsulant may be a polymer material which may be flexible such as for example a silicone. Further, the LEDs may be arranged for emitting LED light e.g. of different colors or spectrums. The encapsulant may comprise a luminescent material that is configured to at least partly convert LED light into converted light. The luminescent material may be a phosphor such as an inorganic phosphor and/or quantum dots or rods.

The LED filament may comprise multiple sub-filaments.

Hence, according to the present invention, there is provided a light emitting diode, LED, filament arrangement. The LED filament arrangement comprises at least one LED filament comprising an array of a plurality of light emitting diodes, LEDs. The LED filament arrangement comprises at least one light distribution element comprising a solid, at least partially translucent material which at least partially encloses the at least one LED filament. The at least one light distribution element has a conical shape and is configured to at least partially refract, and at least partially reflect by total internal reflection, the light emitted from the at least one LED filament during operation.

Thus, the present invention is based on the idea of providing a LED filament arrangement wherein the light distribution element(s) is (are) able to distribute the light emitted from the LEDs of the LED filament(s) via refraction and/or total internal reflection. By the conical-shaped light distribution element(s) of solid, at least partially translucent material, the light emitted from the LED filament(s) arranged therein may emit light from the apex(es), side(s) and/or base(s) of the conical-shaped light distribution element(s), in order to provide an improved and/or desired distribution of light from the LED filament(s) of the LED filament arrangement. In other words, a decorative lighting may be achieved by light outcoupling (refraction) at the side of the light distribution element(s) and optimal spot lighting by light outcoupling (via total internal reflection) at the top of the light distribution elements.

It will be appreciated that the LED filament arrangement may distribute the light emitted from the LEDs of the LED filament(s) from the apex(es) of the conical-shaped light distribution element(s) enclosing the LED filament(s). The present invention is hereby advantageous in that the LED filament arrangement may direct/distribute the light through the apex(es) to achieve a spot light functionality. This spot light functionality may, for example, be provided in an upwards or downwards direction, dependent on the orientation of the light distribution element(s) of the LED filament arrangement.

The LED filament arrangement may furthermore distribute the light emitted from the LEDs of the LED filament(s) from the side(s) of the conical-shaped light distribution element(s) enclosing the LED filament(s) via refraction. As the light distribution element(s) is (are) able to at least partially refract the light in a sidewise manner (side light exit) from the light distribution element(s), the present invention is advantageous in that an even more improved lighting distribution may be achieved for illumination and/or decorative purposes.

The LED filament arrangement may furthermore distribute the light emitted from the LEDs of the LED filament(s) from the base(s) of the conical-shaped light distribution element(s) enclosing the LED filament(s) via total internal reflection (TIR). The present invention is further advantageous in that a spot light functionality may be achieved from the base(s) of the light distribution element(s). It will be appreciated this spot light functionality may, for example, be provided in an upwards or downwards direction, dependent on the orientation of the light distribution element(s) of the LED filament arrangement.

The present invention is further advantageous in that the light distribution element(s) of the LED filament arrangement is (are) versatile, in that the element(s) may be conveniently designed to provide a desired lighting distribution in terms of illumination and/or decorative purposes. For example, the material properties and/or the shape of the conical-shaped light distribution element(s), for changing the refraction and/or reflection properties thereof, may be chosen for different lighting purposes of the LED arrangement.

The present invention is further advantageous in that the LED arrangement may provide a relatively high degree of spatial light distribution during operation. In other words, the light distribution may provide an (almost) omnidirectional light output from the LED arrangement.

It will be appreciated that the LED filament arrangement of the present invention furthermore comprises relatively few components. The relatively low number of components is advantageous in that the LED filament arrangement is relatively inexpensive to fabricate. Moreover, the relatively low number of components of the LED filament arrangement implies an easier recycling, especially compared to devices or arrangements comprising a relatively high number of components which impede an easy disassembling and/or recycling operation.

The LED filament arrangement according to the present invention comprises at least one LED filament. The at least one LED filament, in its turn, comprises an array of LEDs. By the term "array", it is here meant a linear arrangement or chain of LEDs, or the like, arranged on the LED filament(s). The LED filament arrangement comprises at least one light distribution element. By the term "light distribution element", it is here meant an element, structure, unit, or the like, which is configured to distribute, scatter, spread, direct, refract, reflect and/or transfer light emitted through the element. The light distribution element comprises a solid, at least partially translucent material at least partially enclosing the at least one LED filament. By the term "translucent", it is here meant that the material is translucent and/or transparent. It will be appreciated that the advantage of a transparent material at least partially enclosing the LED filament(s) is an improved total internal reflection of the light distribution element and thus an improved light distribution from the LED filament arrangement, such as a spot light effect or omnidirectional light distribution.

Hence, the at least partially translucent and/or transparent material of the light distribution element may completely or partially enclose the LED filament(s). The at least one light distribution element has a conical shape. By "conical shape", it is here meant a cone shape, albeit the "conical shape" may encompass geometric shapes which deviate somewhat from the strict meaning of the term. For example, the "conical shape" of the light distribution element may encompass a round or elliptical shape, a truncated cone, a cone with curved sides of the cone, etc.

The at least one light distribution element is configured to at least partially refract, and at least partially reflect by total internal reflection, the light emitted from the at least one LED filament during operation. Hence, the light distribution element(s) is (are) configured to at least partially change the direction of the light wave propagation due to the transmission through the material of the light distribution element and into the surrounding media. Furthermore, the light distribution element(s) is (are) configured to at least partially reflect the light emitted from the at least one LED filament during operation via total internal reflection (TIR). The term "total internal reflection", which is known by the skilled person, describes the phenomenon which occurs when a propagated light wave strikes a medium boundary at an angle larger than a particular critical angle with respect to the normal to the surface. If the refractive index is lower on the other side of the boundary and the incident angle is greater than the critical angle, the light wave cannot pass through and is entirely reflected.

According to an embodiment of the present invention, the plurality of LEDs may be arranged on a substrate or carrier. The LED filament arrangement may further comprise an encapsulant comprising a luminescent material, wherein the encapsulant at least partially encloses the plurality of LEDs and the surface of the substrate carrying the plurality of LEDs. In a particular embodiment, the substrate may be translucent, and preferably transparent. The (second) surface of the substrate opposite the (first) surface carrying the plurality of LEDs may comprise no LEDs. The second surface of the substrate may also be covered with an encapsulant, which also may comprise a luminescent material. The luminescent material on the second surface may also provide converted light, e.g. LED light or light which has already been converted.

According to an embodiment of the present invention, the at least one LED filament may extend along a longitudinal axis, A, and wherein a central axis, B, of the light distribution element is parallel with the longitudinal axis, A. Hence, the LED filament(s) may extend in parallel with the height of the conical-shaped light distribution element. The present embodiment is advantageous in that a symmetric distribution of light from the LED filament arrangement may be achieved. In addition, the symmetric arrangement of the LED filament(s) with respect to the central axis of the light distribution element(s) may improve the appearance of the LED filament arrangement.

According to an embodiment of the present invention, the at least one light distribution element may further comprise at least one hole, and wherein each LED filament of the at least one LED filament is arranged in a respective hole. For example, the one or more light distribution element(s) may comprise a single hole in which a LED filament is arranged. Alternatively, the one or more light distribution element(s) may comprise two or more holes in which a corresponding number of LED filaments are arranged. The present embodiment is advantageous in that a desired number of LED filaments may be arranged in the light distribution element(s) in order to achieve a desired light distribution and/or aesthetic appearance.

According to an embodiment of the present invention, the apex angle $\alpha$ of the at least one light distribution element is $\alpha=2\theta$, wherein $\theta$ may be 22-28° (preferred), such as 23-26° (more preferred), such as 24° (most preferred). By the term "apex", it is here meant the top or the tip of the light distribution element, having the shape of a (truncated) cone.

In other words, the apex(es) of the conical-shaped light distribution element(s) may form an angle θ with respect to its central axis, B. The present embodiment is advantageous in that the light distribution element(s) may be designed, tuned, shaped and/or formed to provide a desired light distribution as a function of the refraction and/or total internal reflection properties of the light distribution element(s). In particular, as the present embodiment represents a relatively small angle θ of the light distribution element, a relatively large portion of the light emitted from the LED filament(s) during operation may be refracted via the side(s) from the light distribution element(s).

According to an embodiment of the present invention, the apex angle α of the at least one light distribution element is α=2θ, wherein θ may be 30-40° (preferred), such as 30-38° (more preferred), such as 30-35° (most preferred). The present embodiment is advantageous in that the light distribution element(s) may be designed, tuned, shaped and/or formed to provide a desired light distribution as a function of the refraction and/or total internal reflection properties of the light distribution element(s). As the present embodiment represents a relatively large angle θ of the light distribution element, a relatively large portion of the light emitted from the LED filament(s) during operation may be reflected and emitted via the base portion of the conical shape of the light distribution element(s), to achieve a spot light effect. More specifically, in case of θ=35°, a particularly advantageous light distribution may be achieved upon operation of the LED filament arrangement. The present embodiment is further advantageous in case the LED filament(s) of the LED filaments arrangement are relatively thick.

According to an embodiment of the present invention, the at least one LED filament has a length, L, and wherein the first light distribution element has a height, H, wherein L/H may be 0.5-0.95, such as 0.6-0.92, such as 0.7-0.9. In other words, the LED filament length(s) may be smaller than the height(s) of the conical-shaped light distribution element(s). The present embodiment is advantageous in that an even more aesthetical appearance of the LED filament(s) and/or LED filament arrangement may be achieved, in particular due to the fact that the LED filament(s) may be clearly visible.

According to an embodiment of the present invention, the at least one LED filament has a length, L, and the first light distribution element has a height, H, wherein L/H is 1.1-2.5, such as 1.2-2.0, such as 1.2-1.8. In other words, and in contrast to the previous embodiment, the LED filament length(s) may be larger than the height(s) of the conical-shaped light distribution element(s). The present embodiment is advantageous in that the light distribution element(s) may appear more compact or slim, whilst being able to provide a sufficient and/or satisfactory distribution of light during operation of the LED filament arrangement.

According to an embodiment of the present invention, the at least one light distribution element may be a collimator configured to collimate at least a portion of the light emitted from the at least one LED filament during operation. By the term "collimate", it is here meant making at least a portion of the light rays mutually parallel and/or reduce mutual angles between the light rays. The present embodiment is advantageous in that the collimator may enable a homogeneous distribution and collimation of the light emitted from the LED filament arrangement during operation, e.g. for spot light effects.

According to an embodiment of the present invention, the LED filament arrangement may comprise a first light distribution element and a second light distribution element, wherein the first and second light distribution elements are adjacently arranged along a common axis, D, which coincides with the respective central axis of the first and second light distribution elements. Hence, the LED filament arrangement may comprise two conical-shaped light distribution elements which are arranged in series or being "stacked". The present embodiment is advantageous in that a desired distribution of light from the LED filament arrangement may be achieved. More specifically, a substantially omnidirectional light distribution during operation of the LED filament arrangement may be achieved.

According to an embodiment of the present invention, the first and second light distribution elements may have an identical shape. Hence, the two conical-shaped light distribution elements may have the same shape and dimensions. The present embodiment is advantageous in that a symmetric light distribution pattern may be obtained during operation of the LED filament arrangement, which may be desired for illumination and/or aesthetic purposes.

According to an embodiment of the present invention, the first and second light distribution elements may be arranged such that the apexes or the bases of the first and second light distribution elements face each other. Hence, the LED filament arrangement may comprise two conical-shaped light distribution elements which are adjacently arranged such that the respective apexes face each other, or alternatively, that the respective bases face each other. In case of facing apexes, it will be appreciated that the present arrangement of the two conical-shaped light distribution elements of the LED filament arrangement may resemble that of a diabola. The present embodiment is advantageous in that a substantially omnidirectional light distribution during operation of the LED filament arrangement may be obtained.

According to an embodiment of the present invention, the first and second light distribution elements may be arranged such that the bases of the first and second light distribution elements face each other. Hence, the LED filament arrangement may comprise two conical-shaped light distribution elements which are adjacently arranged such that the respective bases face each other. By this arrangement, at least a portion of the light emitted from the LED filament(s) in the first light distribution element may be directed into the second light distribution element, which furthermore refracts the light. Analogously, at least a portion of the light emitted from the LED filament(s) in the second light distribution element may be directed into the first light distribution element, which furthermore refracts the light. The effect of this particular LED filament arrangement is a substantially omnidirectional light distribution.

According to an embodiment of the present invention, the first and second light distribution elements may be arranged in series such that the apex of the first light distribution element faces the base of the second light distribution element. It will be appreciated that the present arrangement of the two conical-shaped light distribution elements of the LED filament arrangement hereby may have a Christmas tree appearance. The present embodiment is advantageous in that a desired light distribution and/or aesthetic appearance of the LED filament arrangement may be achieved.

According to an embodiment of the present invention, the at least one LED filament may be configured to emit light omnidirectionally in the plane perpendicular to the longitudinal axis, A. By the term "omnidirectionally", it is here meant that the light from the LED filament(s) may be emitted in all directions. Hence, according to the embodiment, the light from the LED filament(s) may be emitted in a circumferential manner with respect to the arrangement of the LED filament(s) along the longitudinal axis. As the LED filament(s) of the LED filament arrangement may provide a distribution of light into (almost) all directions from the LED filament(s), the present embodiment is advantageous in that a desired and/or customized lighting may be achieved.

According to an embodiment of the present invention, there is provided a lighting device. The lighting device comprises a LED filament arrangement according to any one of the preceding embodiments. The lighting device further comprises a cover comprising an at least partially light transmissive material, wherein the cover at least partially encloses the LED filament arrangement. The lighting device further comprises an electrical connection connected to the LED filament arrangement for a supply of power to the plurality of LEDs of the LED filament arrangement. By the term "light transmissive", it is here meant translucent and/or transparent. It will be appreciated that a transparent material of the cover is desired for aesthetical purposes and that it minimizes any effect of the distribution of light from the LED filament arrangement during operation. By the term "cover", it is here meant an enclosing element, such as a cap, cover, envelope, or the like, comprising an at least partial translucent and/or transparent material. The present embodiment is advantageous in that the LED arrangement according to the invention may be conveniently arranged in substantially any lighting device, such as a LED filament lamp, luminaire, lighting system, or the like. The lighting device may further comprise a driver for supplying power the LEDs of the LED filament arrangement. Additionally, the lighting device may further comprise a controller for individual control of two or more subsets of LEDs of the LED filament arrangement, such as a first set of LEDs, a second set of LEDs, etc.

According to an embodiment of the present invention, the lighting device may comprise the LED filament arrangement according to any one of the previously described embodiments. The cover of the lighting device may be bulb-shaped and may comprise a top portion and a base portion, wherein the light distribution element is at least partially enclosed by the cover. The light distribution element is further oriented in the cover such that the apex of the light distribution element is directed towards the base portion of the cover, and the base of the light distribution element is directed towards the top portion of the cover. The present embodiment is advantageous in that the lighting device may constitute a retrofit lighting device which has the look of an incandescent bulb, whilst still being able to provide the advantages according to the LED filament arrangement according to one or more of the previously mentioned embodiments.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
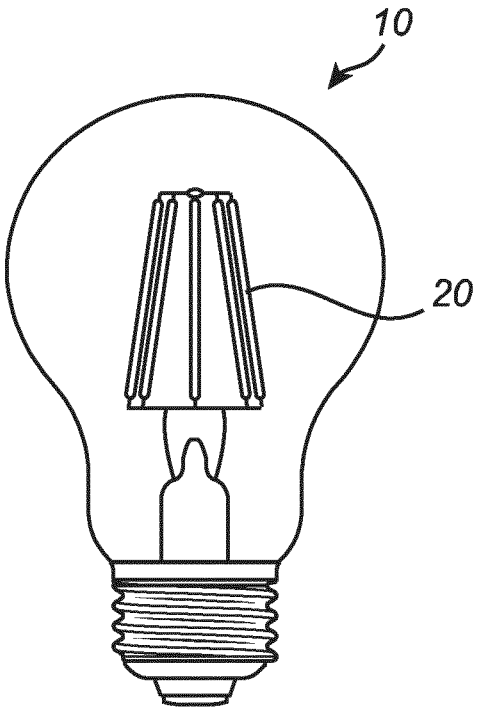
FIG. 1 schematically shows a LED filament lamp according to the prior art, comprising LED filaments, FIG. 2 schematically shows a LED filament of a LED filament arrangement according to an exemplifying embodiment of the present invention, FIG. 3 schematically shows a LED filament arrangement according to an exemplifying embodiment of the present invention, FIG. 4 schematically shows a portion of a LED filament arrangement according to an exemplifying embodiment of the present invention, FIGS. 5-7 schematically show LED filament arrangements as well as light distribution intensity patterns and emitted light rays for each LED filament arrangement, respectively, FIGS. 8-9 schematically show LED filament arrangements according to exemplifying embodiments of the present invention, and FIG. 10 schematically shows a lighting device comprising a LED filament arrangement according to an exemplifying embodiment of the present invention.

FIG. 1 shows a LED filament lamp 10 according to the prior art, comprising a plurality of LED filaments 20. LED filament lamps 10 of this kind are highly appreciated as they are very decorative, as well as providing numerous advantages compared to incandescent lamps such as a longer operational life, a reduced power consumption, and an increased efficiency related to the ratio between light energy and heat energy. However, as LED filament lamps 10 of this kind are often intended for decorative applications, the lamps may suffer from an unsatisfactory light distribution. For example, the LED filaments 20 may have a substantially dipolar emission pattern, wherein the light emission at angles parallel to the elongation of the filament may be low, or even non-existing.

Figure 2:
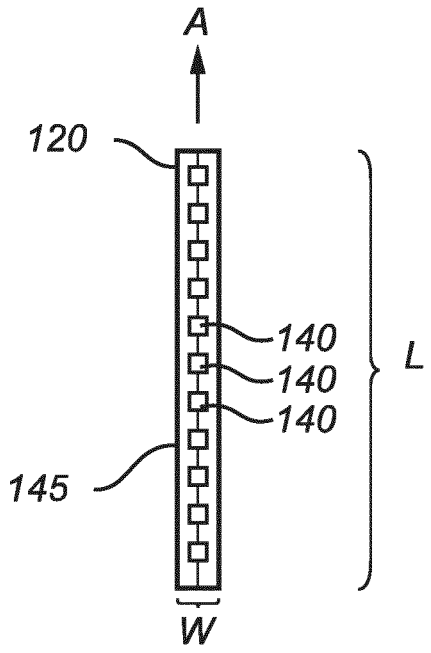

FIG. 2 schematically shows a LED filament 120, elongating along an axis A. The elongate (oblong) LED filament 120 may preferably have a length L in the range from 1 cm to 20 cm, more preferably 2 cm to 12 cm, and most preferred 3 cm to 10 cm. The LED filament 120 may preferably have a width W in the range from 0.5 mm to 10 mm, more preferably 0.8 mm to 8 mm, and most preferred 1 to 5 mm. The aspect ratio L/W is preferably at least 5, more preferably at least 8, and most preferred at least 10.

The LED filament 120 comprises an array or "chain" of LEDs 140 which is arranged on the LED filament 120. For example, the array or "chain" of LEDs 140 may comprise a plurality of adjacently arranged LEDs 140 wherein a respective wiring is provided between each pair of LEDs 140. The plurality of LEDs 140 preferably comprises more than 5 LEDs, more preferably more than 8 LEDs, and even more preferred more than 10 LEDs. The plurality of LEDs 140 may be direct emitting LEDs which provide a color. The LEDs 140 are preferably blue LEDs. The LEDs 140 may also be UV LEDs. A combination of LEDs 140, e.g. UV LEDs and blue light LEDs, may be used. The LEDs 140 may comprise laser diodes. The light emitted from the LED filament 120 during operation is preferably white light. The white light is preferably within 15 SDCM (standard deviation of color matching) from the black body locus (BBL). The color temperature of the white light is preferably in the range of 2000 to 6000 K, more preferably in the range from 2100 to 5000 K, most preferably in the range from 2200 to 4000 K such as for example 2300 K or 2700 K. The white light has preferably a CRI of at least 75, more preferably at least 80, most preferably at least 85 such as for example 90 or 92.

The LED filament 120 may further comprise an encapsulant 145 comprising a translucent material, wherein the encapsulant 145 at least partially encloses the plurality of LEDs 140. For example, and as indicated in FIG. 2, the encapsulant 145 fully encloses the plurality of LEDs 140. The encapsulant 145 may comprise a luminescent material, which is configured to emit light under external energy excitation. For example, the luminescent material may comprise a fluorescent material. The luminescent material may comprise an inorganic phosphor, and organic phosphor and/or quantum dots/rods. The UV/blue LED light may be partially or fully absorbed by the luminescent material and converted to light of another color e.g. green, yellow, orange and/or red.

Figure 3:
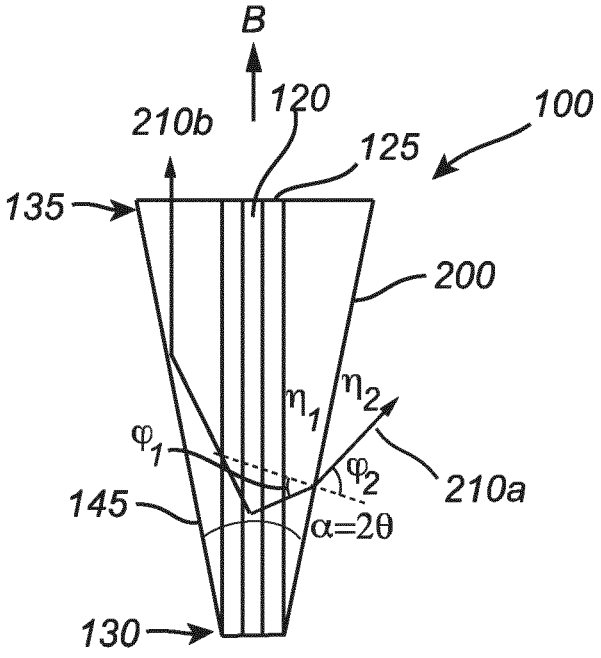

FIG. 3 shows a LED filament arrangement 100 according to an exemplifying embodiment of the present invention. It will be appreciated that the LED filament arrangement 100 may be provided in a LED filament lamp according to FIG. 1 or in substantially any other lighting device, arrangement or luminaire. The LED filament arrangement 100 comprises a LED filament 120, e.g. according to FIG. 2. It should be noted that there may be a plurality or any number of LED filaments, for example 2, 3, 4, 5, or 6 LED filaments 120 in a single hole 125, whereas only one LED filament 120 is shown in FIG. 3 for an increased understanding. The LED filament 120 comprises an array of a plurality of light emitting diodes, LEDs. In FIG. 3, the LEDs are arranged along the longitudinal axis, A, as shown in FIG. 2.

The LED filament arrangement 100 in FIG. 3 further comprises a light distribution element 200. The light distribution element 200 has the shape of a (truncated) cone, and extends along a central axis B. The light distribution element 200 may alternatively have a spherical or elliptical shape. It should be noted that there may be a plurality (substantially any number) of light distribution elements 200, for example, 2, 3, 4, 5 or 6 light distribution elements 200. In case of a plurality of LED filaments 120 being arranged in a (single) light distribution element 200, the LED filaments are preferably symmetrically arranged. In FIG. 3, however, only one light distribution element 200 is shown in for an increased understanding. The light distribution element 200 comprises a solid, at least partially translucent material. This material may, for example, comprise glass, sapphire, and/or quartz. The light distribution element 200 comprises a centrally arranged hole 125 in which the LED filament 120 is arranged, wherein the hole 125 is provided between the apex 130 and the base 135 of the light distribution element 200. Preferably, the light distribution element 200 has only one (single) hole 125, which generates a relatively high light output without other holes causing optical distortion. Furthermore, it may also be preferred to provide more than one LED filament 120 in a single hole 125, for aesthetical (appearance) reasons. Preferably >2, more preferred >3, and most preferred >4 LED filaments 120 may be arranged in a single hole 125 of the light distribution element 200.

Alternatively, the light distribution element 200 may comprise two or more holes in which a corresponding number of LED filaments 120 may be arranged. In the embodiment of FIG. 2, the light distribution element 200 encloses the LED filament 120, and the LED filament 120 is coaxially arranged with the axis B of the light distribution element 200. The length of the LED filament 120 corresponds to the length of the light distribution element 200 along its axis B. The light distribution element 200 has a conical shape, wherein the apex of the conical shape has an angle $\alpha=2\theta$. In FIG. 3, the conical shape of the light distribution element 200 is realized as having a circular base 135 and straight sides 145 leading to the apex 130 of the cone. However, the sides 145 of the light distribution element 200 may alternatively be curved, i.e. concavely or convexly curved with respect to the axis B.

The light distribution element 200 as exemplified in FIG. 3 is configured to at least partially refract, and at least partially reflect by total internal reflection, the light emitted from the LED filament 120 during operation. This is schematically indicated by the example of rays of the bundles of light 210*a*, 210*b* as emitted by the LED filament 120. The light rays of the bundle of light 210*a* are emitted sideways from the conical-shaped light distribution element 200, and their respective direction of refraction is dependent on Snell's law, i.e. $\sin\varphi_2/\sin\varphi_1=\eta_1/\eta_2$, wherein $\varphi_1$ is the angle which the direction of the light rays from the LED filament 120 forms with the normal of the side of the conical-shaped light distribution element 200, $\varphi_2$ is the angle which the direction of the light rays leave the side of the conical-shaped light distribution element 200, $\eta_1$ is the refractive index of the material of the light distribution element 200 and $\eta_2$ is the refractive index of the ambient medium. The example of the light rays of the bundle of light 210*b* are emitted from the base 135 of the conical-shaped light distribution element 200, due to total internal reflection (TIR). It will be appreciated that properties such as the shape and/or material of the cone of the light distribution element 200 influences the refraction and reflection properties of the light distribution element 200 of the LED filament arrangement 100 such that a desired light distribution may be obtained from the LED filament arrangement 100 during operation. For example, the light distribution element 200 may further comprise at least one reflector (e.g. one or more mirrors) configured to at least partially collimate the light emitted from the LED filament 120 during operation. Alternatively, or in combination with the above, the reflector(s) may comprise a coating for diffuse reflection of the light emitted from the LED filament 120. For example, the coating may comprise particles of $TiO_2$, $BaSO_4$ and/or $Al_2O_3$. Alternatively, or in combination, the reflector(s) may comprise at least one surface which has been treated for diffuse reflection of the light emitted from the LED filament 120. The light distribution element 200 may further be configured to provide TIR for the light emitted from the LED filament 120 during operation. Furthermore, in combination with one or more of the above-mentioned features, the light distribution element 200 may furthermore be colored to obtain a desired color of the light emitted from the LED filament arrangement 100 and/or for aesthetical purposes. Alternatively, or in combination, the LED filament 120 may be optically coupled (albeit partially) to the light distribution element 200 for adjusting the color temperature (not shown).

Figure 4:
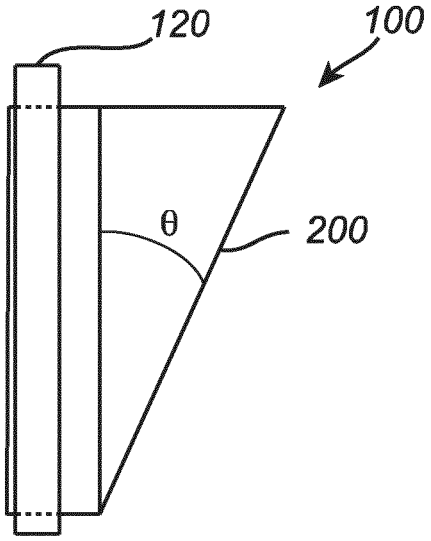

FIG. 4 schematically shows a portion of a light distribution element 200 and a LED filament 120 of a LED filament arrangement 100. More specifically, the portion represents a half-conical shape of the light distribution element 200 for an increased understanding of the following embodiment: the apex angle $\alpha$ of the conical-shaped light distribution element is $\alpha=2\theta$, wherein $\theta$ may be 22-28°, such as 23-26°, such as 24° with respect to its central axis, B. According to another embodiment of the present invention, $\theta$ may be 30-40°, such as 30-38°, such as 30-35°. The embodiments exemplify designs, shapes and/or forms of the light distribution element 200 for providing a desired light distribution as a function of the refraction and/or total internal reflection properties of the light distribution element 200. In case of a relatively small angle θ of the light distribution element 200, a relatively large portion of the light emitted from the LED filament 120 during operation may be refracted via the sides of the light distribution element 200. In contrast, in case of a relatively large angle θ of the light distribution element 200, a relatively large portion of the light emitted from the LED filament 120 during operation may be reflected and emitted via the base portion of the conical shape of the light distribution element 200, to achieve a spot light effect. The latter example may further be particularly advantageous in case the LED filament 120 of the LED filament arrangement 100 is relatively thick.

Figure 5C:
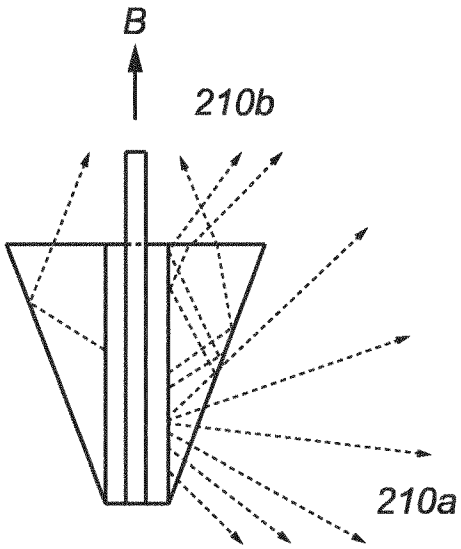
Figure 5B:
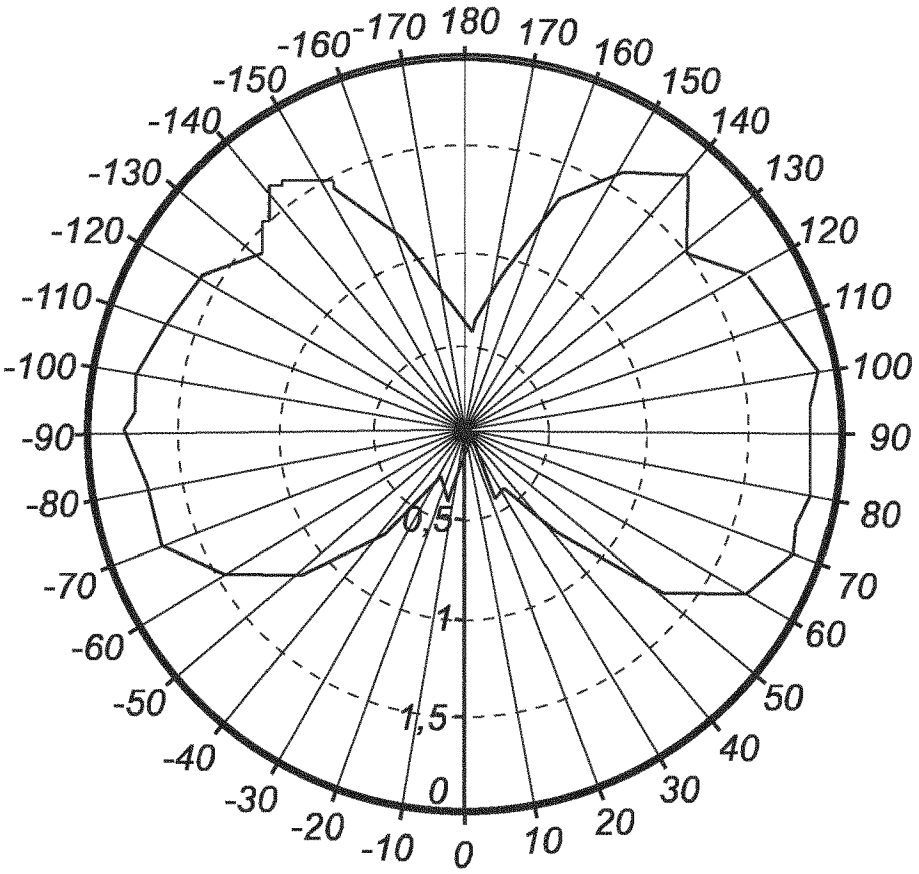
Figure 5A:
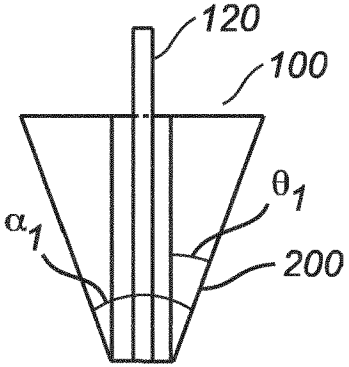
Figure 6C:
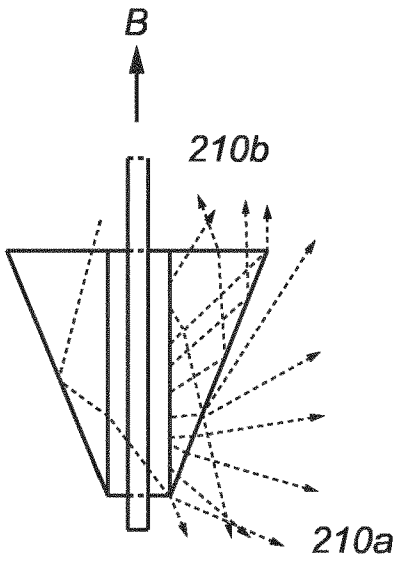
Figure 6B:
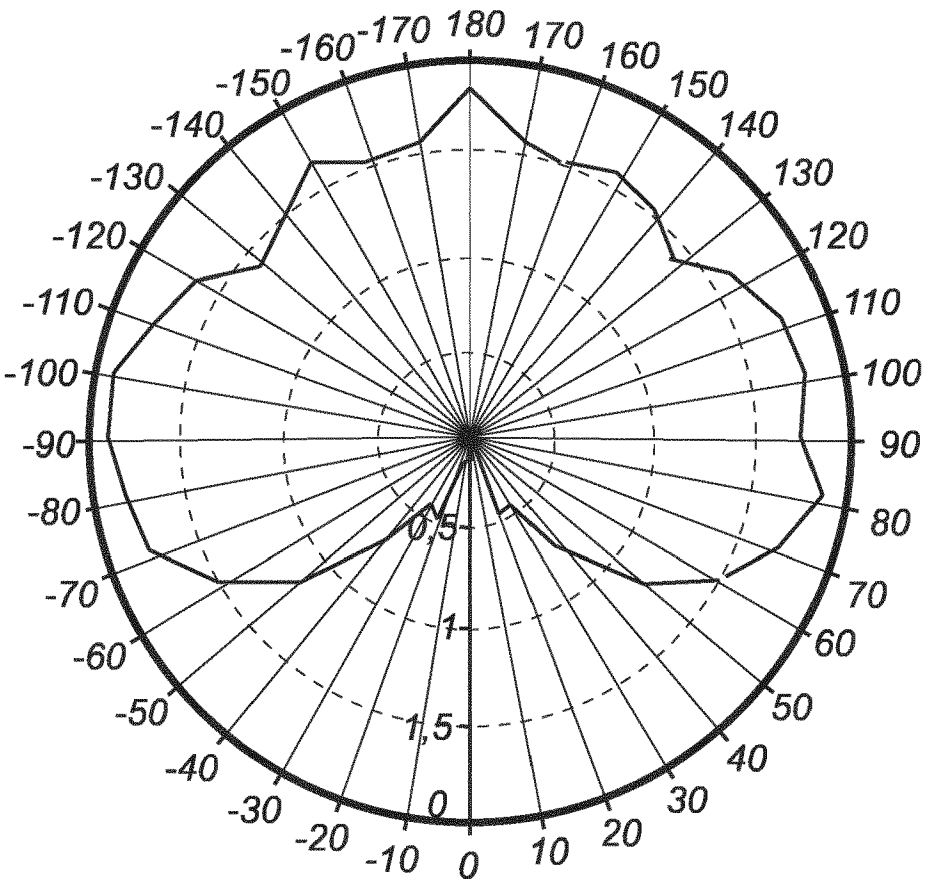
Figure 6A:
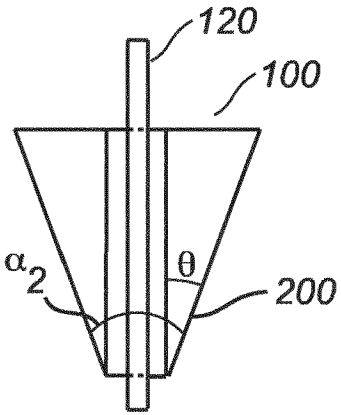
Figure 7C:
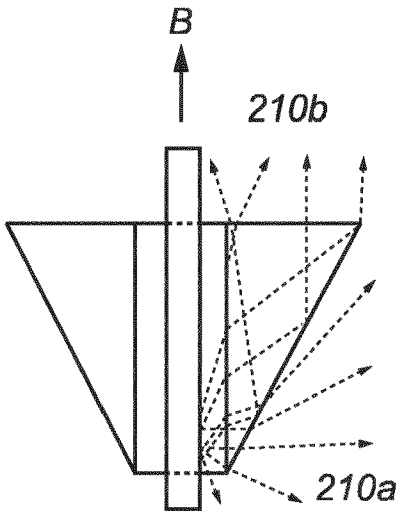
Figure 7B:
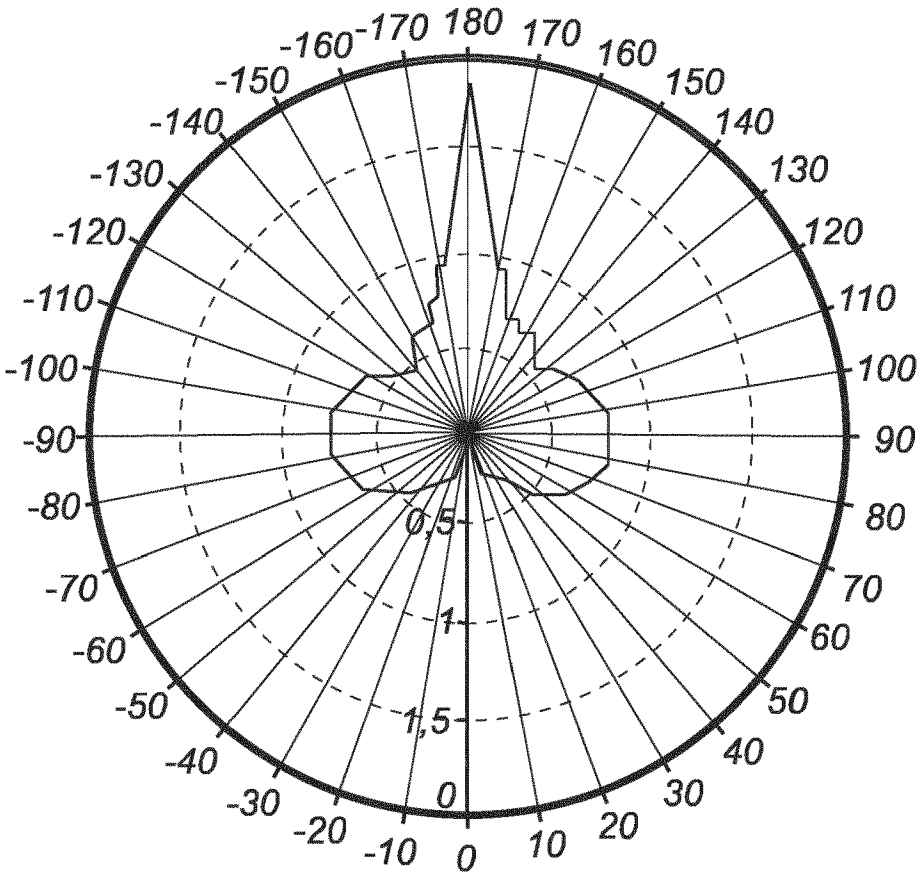
Figure 7A:
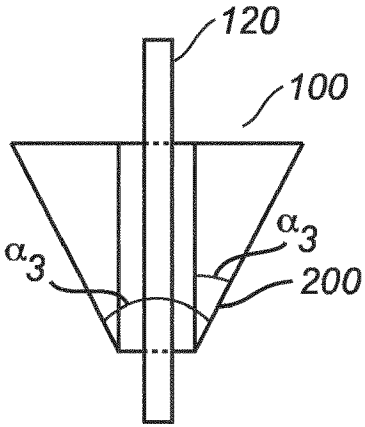

Each of FIGS. 5*a*, 6*a* and 7*a* schematically shows a light distribution element 200 and a LED filament 120 of a LED filament arrangement 100 according to FIG. 3 and/or FIG. 4. It should be noted that some references have been omitted for reasons of an increased understanding, and it is referred to FIG. 3 and/or FIG. 4 for the configuration and/or properties of the light distribution element 200. The apex angle $\alpha_{1,2,3}$ of the respective conical-shaped light distribution element 200 is $\alpha_{1,2,3}=2\theta_{1,2,3}$, wherein $\theta_1=22°$ for the light distribution element 200 in FIG. 5*a*, wherein $\theta_2=25°$ for the light distribution element 200 in FIG. 6*a*, and wherein $\theta_3=28°$ for the light distribution element 200 in FIG. 7*a*. Due to the difference in apex angle α, the light distribution elements 200 provide different light distribution intensity patterns. This is shown in the respective diagrams of FIGS. 5*b*, 6*b* and 7*b* associated with the respective LED filament arrangements 100, schematically showing the light intensity as a function of the azimuth angle with respect to the axis B. For example, the light distribution intensity pattern of FIG. 5*b* for the light distribution element 200 of $\theta_1$ shows a relatively large light intensity in a sideways direction of the light distribution element 200, such as in the range 60-140° from the central axis B of the light distribution element 200. The light distribution intensity pattern of FIG. 5*b* further shows a relatively small light intensity in a direction which is substantially parallel to the central axis B, such as in the range ±20° from the central axis B of the light distribution element 200. Notably, there is almost no light emitted downwards (according to the depicted orientation) from the LED filament arrangement 100. In FIG. 6*b*, corresponding to the light distribution element 200 of $\theta_2$, shows that the light distribution intensity is similar to that of FIG. 5*b* with respect to the downwards and sideways directions. However, compared to FIG. 5*b*, the light distribution intensity in FIG. 6*b* is high in an upwards direction parallel to the central axis B. In FIG. 7*b*, the light distribution intensity pattern shows a distinct peak in an upwards direction parallel to the central axis B, clearly indicating a spot light effect of the associated LED filament arrangement 100.

Each of FIGS. 5*c*, 6*c* and 7*c* schematically shows the light rays emitted from a specific point of the LED filament 120 of the respective LED filament arrangement 100 of FIGS. 5*a*, 6*a*, and 7*a*. Hence, the schematically indicated light rays of FIGS. 5*c*, 6*c*, and 7*c* correspond to (or are associated with) the respective light distribution intensity patterns of FIGS. 5*b*, 6*b*, and 7*b*. Accordingly, in FIG. 5*c*, the light rays of the bundle of light 210*a* which are emitted sideways from the conical-shaped light distribution element 200 due to refraction lead to a relatively high intensity in the range 60-140° from the central axis B of the light distribution element 200. Furthermore, the light rays of the bundle of light 210*b* which are emitted from the base 135 of the conical-shaped light distribution element 200 are not parallel to the central axis B, indicating a relatively small light intensity in this direction. It is also clear from FIG. 5*c* that almost no light is emitted downwards (according to the depicted orientation) from the LED filament arrangement 100.

In FIG. 6*c*, the light rays of the bundle of light 210*a* is similar to that of FIG. 5*c* with respect to the sideway direction of the light distribution element 200. However, compared to FIG. 5*c*, the light rays of the bundle of light 210*b* in FIG. 6*c* are, to a larger extent, emitted in the upwards direction parallel to the central axis B. Analogously, in FIG. 7*c*, the light rays of the bundle of light 210*b* show a distinct peak in an upwards direction parallel to the central axis B, clearly indicating a spot light effect of the associated LED filament arrangement 100.

Figure 8A:
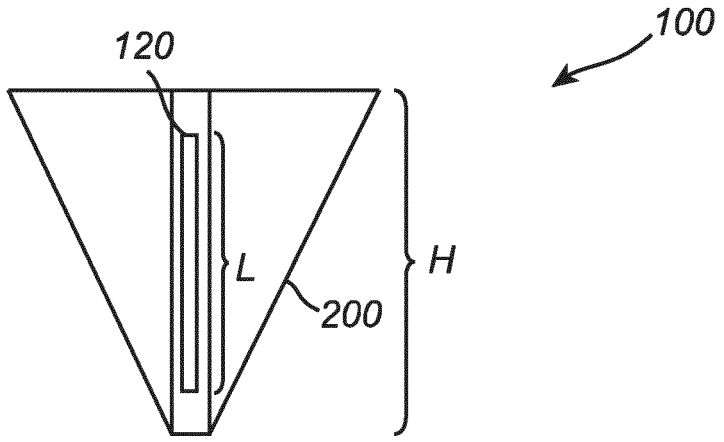
Figure 8B:
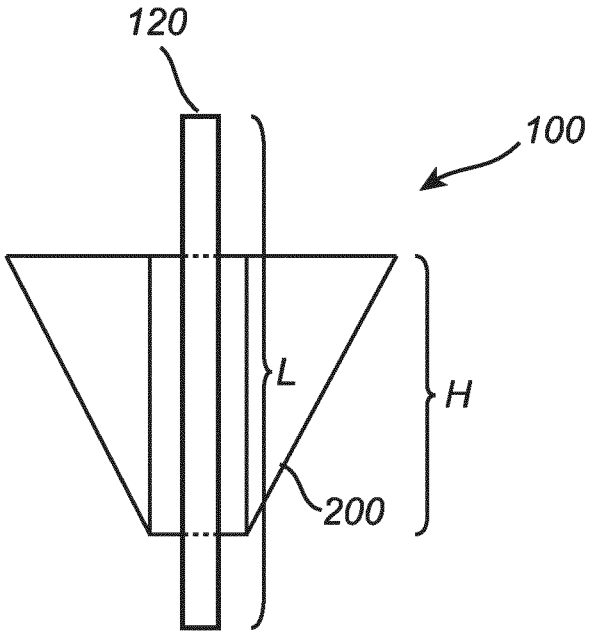

FIGS. 8*a* and 8*b* are schematic illustrations of LED filaments arrangement 100 according to embodiments of the present invention. It should be noted that some references have been omitted for reasons of an increased understanding, and it is referred to FIG. 3 and/or FIG. 4 for the configuration and/or properties of the light distribution element 200. In FIG. 8*a*, the LED filament 120 has a length L and the light distribution element 200 has a height, H, wherein L/H may be 0.5-0.95, such as 0.6-0.92, such as 0.7-0.9. In other words, the length L of the LED filament 120 is smaller than the height H of the conical-shaped light distribution element 200. In FIG. 8*b*, which is another schematic illustration of a LED filament arrangement 100 according to an embodiment of the present invention, the opposite relationship to that of FIG. 8*a* is shown. Here, the ratio L/H between the length L of the LED filament 120 and the height H of the light distribution element 200 is 1.1-2.5, such as 1.2-2.0, such as 1.2-1.8. In other words, and in contrast to the previous embodiment in FIG. 8*a*, the length L of the LED filament 120 is larger than the height H of the conical-shaped light distribution element 120.

FIGS. 9*a-d* are schematic illustrations of LED filament arrangements 100, each comprising two light distribution elements 200, according to exemplifying embodiments of the present invention. Common to all embodiments in FIGS. 9*a-d* is that the respective LED filament arrangement 100 comprises a first light distribution element 200*a* and a second light distribution element 200*b*. The first and second light distribution elements 200*a*, 200*b* are adjacently arranged along a common axis, D, which coincides with the respective central axis of the first and second light distribution elements 200*a*, 200*b*. It should be noted that some references of the light distribution elements 200*a*, 200*b* have been omitted for reasons of an increased understanding, and it is referred to FIG. 3 and/or FIG. 4.

Figure 9A:
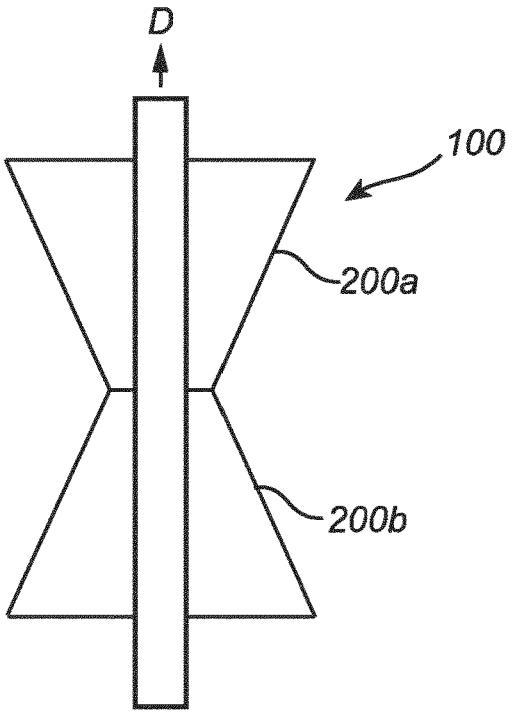

In FIG. 9*a*, the first light distribution element 200*a* and the second light distribution element 200*b* are arranged such that the apexes of the first and second light distribution elements 200*a*, 200*b* face each other. Hence, the arrangement of the two identical and conical-shaped light distribution elements 200*a*, 200*b* of the LED filament arrangement 100 resembles that of a diabola.

Figure 9B:
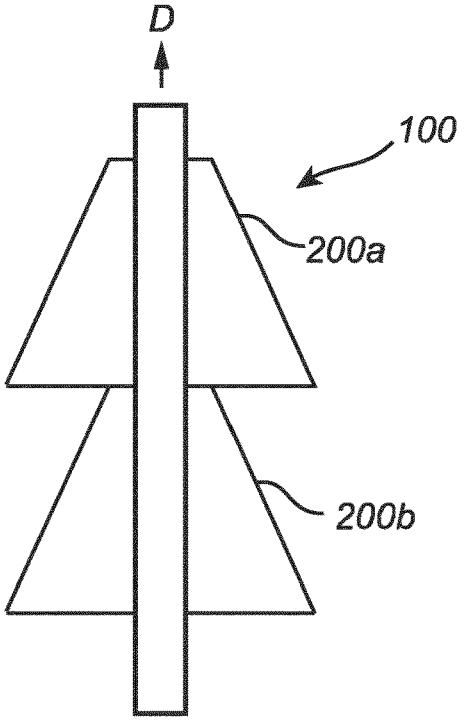

In FIG. 9*b*, the first and second light distribution elements 200*a*, 200*b* are arranged in series such that the apex of the first light distribution element faces (is oriented towards) the base of the second light distribution element. The configuration or arrangement of the first and second light distribution elements 200*a*, 200*b* of the LED filament arrangement 100 may hereby resemble a Christmas tree.

Figure 9C:
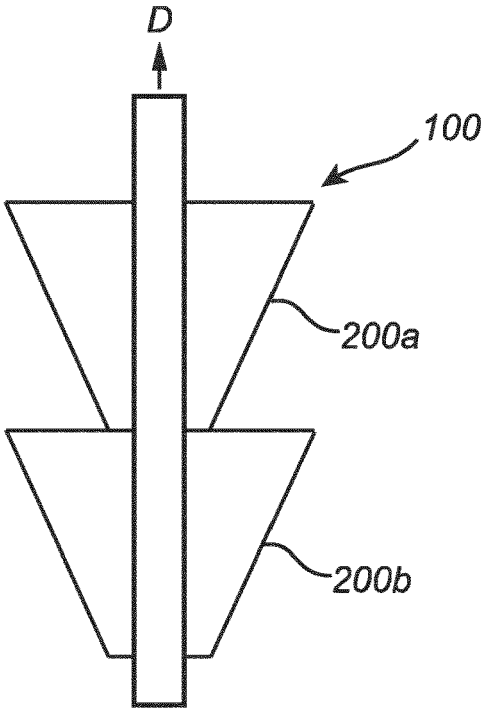

FIG. 9*c* shows an analogous arrangement to that of FIG. 9*b*, in that the first and second light distribution elements 200*a*, 200*b* are arranged in series such that the apex of the first light distribution element is oriented towards the base of the second light distribution element.

Figure 9D:
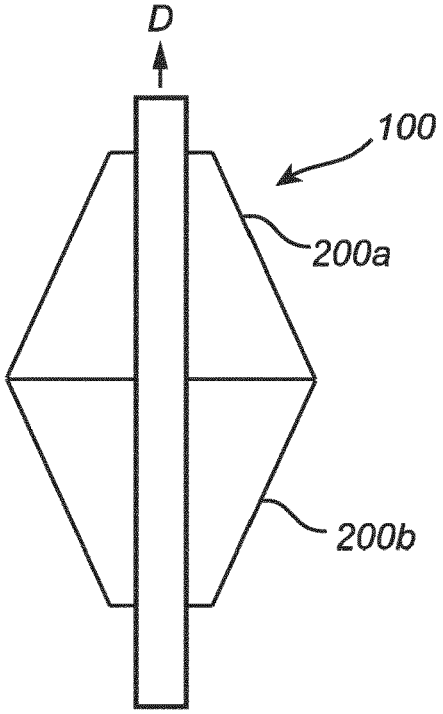

In FIG. 9*d*, the first light distribution element 200*a* and the second light distribution element 200*b* are arranged such that the bases of the first and second light distribution elements 200*a*, 200*b* face each other.

It should be noted that although all arrangements or configurations of FIGS. 9*a*-9*d* show that the two light distribution elements 200*a*, 200*b* are in contact, there may alternatively be provided a space (not shown) between and/or below the two light distribution elements 200*a*, 200*b*. As yet another alternative, a spacer (not shown) may be provided between the two light distribution elements 200*a*, 200*b* and/or on top and/or below at least one of the two light distribution elements 200*a*, 200*b*.

Figure 10:
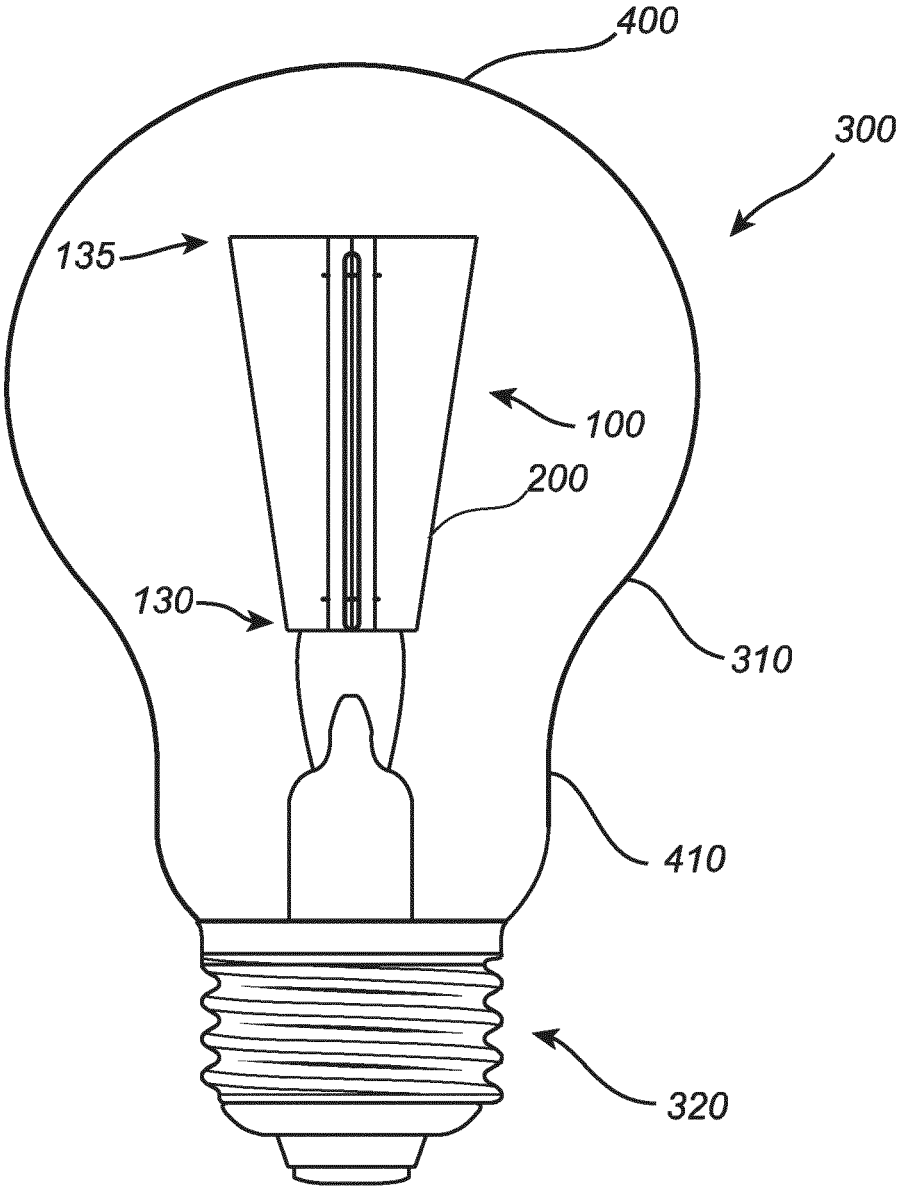

FIG. 10 schematically shows a lighting device 300. The lighting device 300 comprises a LED filament arrangement 100, which in turn comprises a light distribution element 200, according to any previously exemplified embodiment of the present invention. The lighting device 300 further comprises a cover 310, which is exemplified as being bulb-shaped and comprising a top portion 400 and a base portion 410. The cover 310 comprises an at least partially light transmissive (e.g. transparent) material and at least partially encloses the LED filament arrangement 100. The light distribution element 200 is enclosed by the cover 310. The light distribution element 200 is oriented in the cover 310 such that the apex 130 of the light distribution element 200 is directed towards the base portion 410 of the cover 310 of the lighting device 300, and the base 135 of the light distribution element 200 is directed towards the top portion 400 of the cover 310 of the lighting device 300. Alternatively (not shown), the light distribution element 200 may be oriented in the cover 310 such that the apex 130 of the light distribution element 200 is directed towards the top portion 400 of the cover 310 of the lighting device 300, and the base 135 of the light distribution element 200 is directed towards the base portion 410 of the cover 310 of the lighting device 300. The lighting device 300 further comprises an electrical connection 320 connected to the LED filament arrangement 100 for a supply of power to the plurality of LEDs of the LED filament arrangement 100.

The person skilled in the art realizes that the present invention by no means is limited to the preferred embodiments described above. On the contrary, many modifications and variations are possible within the scope of the appended claims. For example, one or more of the LED filament(s) 120, the light distribution element(s) 200*a*, 200*b*, etc., may have different shapes, dimensions and/or sizes than those depicted/described.

The invention claimed is:

1. A light emitting diode, LED, filament arrangement, comprising at least one LED filament comprising an array of a plurality of light emitting diodes, LEDs, arranged for emitting light during operation and at least one light distribution element comprising a solid, at least partially translucent material and a hole at least partially enclosing the at least one LED filament, wherein the at least one light distribution element has a conical shape having an apex and a base that are connected by the sides, said one light distribution element is configured to at least partially refract the light and emit said light via the sides, and at least partially reflect the light by total internal reflection and emit said light via the base.

2. The LED filament arrangement according to claim 1, wherein the at least one LED filament extends along a longitudinal axis, A, and wherein a central axis, B, of the light distribution element is parallel with the longitudinal axis, A.

3. The LED filament arrangement according to claim 1, wherein the at least one light distribution element further comprises at least one hole, and wherein each LED filament of the at least one LED filament is arranged in a respective hole.

4. The LED filament arrangement according to claim 1, wherein an apex angle $\alpha$ of the at least one light distribution element is $\alpha=2\theta$, wherein $\theta$ is 22-28.

5. The LED filament arrangement according to claim 1, wherein an apex angle $\alpha$ of the at least one light distribution element is $\alpha=2\theta$, wherein $\theta$ is 30-40.

6. The LED filament arrangement according to claim 1, wherein the at least one LED filament has a length, L, and wherein the first light distribution element has a height, H, wherein L/H is 0.5-0.95.

7. The LED filament arrangement according to claim 1, wherein the at least one LED filament has a length, L, and wherein the first light distribution element has a height, H, wherein L/H is 1.1-2.5.

8. The LED filament arrangement according to claim 1, wherein the at least one light distribution element is a collimator configured to collimate at least a portion of the light emitted from the at least one LED filament during operation.

9. The LED filament arrangement according to claim 1, comprising a first light distribution element and a second light distribution element, wherein the first and second light distribution elements are adjacently arranged along a common axis, D, which coincides with the respective central axis of the first and second light distributions element.

10. The LED filament arrangement according to claim 9, wherein the first and second light distribution elements have an identical shape.

11. The LED filament arrangement according to claim 9, wherein the first and second light distribution elements are arranged such that the apexes or the bases of the first and second light distribution elements face each other.

12. The LED filament arrangement according to claim 9, wherein the first and second light distribution elements are arranged in series such that the apex of the first light distribution element faces the base of the second light distribution element.

13. The LED filament arrangement according to claim 1, wherein the at least one LED filament is configured to emit light omnidirectionally in the plane perpendicular to the longitudinal axis, A.

14. A lighting device, comprising a LED filament arrangement according to claim 1, a cover comprising an at least partially light transmissive material, wherein the cover at least partially encloses the LED filament arrangement, and an electrical connection connected to the LED filament arrangement for a supply of power to the plurality of LEDs of the LED filament arrangement.

15. A lighting device, comprising a LED filament arrangement according to claim 1, a cover comprising an at least partially light transmissive material, wherein the cover at least partially encloses the LED filament arrangement, and an electrical connection connected to the LED filament arrangement for a supply of power to the plurality of LEDs of the LED filament arrangement, wherein the cover is bulb-shaped and comprises a top portion and a base portion, wherein the light distribution element is at least partially enclosed by the cover and further oriented in the cover such that the apex of the light distribution element is directed towards the base portion of the cover, and the base of the light distribution element is directed towards the top portion of the cover.

* * * * *